US006749697B2

(12) United States Patent
Bergström et al.

(10) Patent No.: US 6,749,697 B2
(45) Date of Patent: Jun. 15, 2004

(54) DUPLEX STAINLESS STEEL

(75) Inventors: Örjan Bergström, Sandviken (SE); Pasi Kangas, Sandviken (SE); Mattias Klockars, Gävle (SE); Guocai Chai, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/796,442

(22) Filed: Mar. 2, 2001

(65) Prior Publication Data

US 2001/0031217 A1 Oct. 18, 2001

(30) Foreign Application Priority Data

Mar. 2, 2000 (SE) ..... 0000678-3

(51) Int. Cl.[7] ..... C22C 38/44

(52) U.S. Cl. ..... 148/325; 420/46; 420/57; 420/59; 420/65

(58) Field of Search ..... 420/46, 57, 59, 420/65; 148/325

(56) References Cited

U.S. PATENT DOCUMENTS

| | | | | | |
|---|---|---|---|---|---|
| 3,865,639 | A | * | 2/1975 | Bellot et al. | 148/521 |
| 4,556,240 | A | * | 12/1985 | Yoshida | 138/109 |
| 4,640,817 | A | * | 2/1987 | Kajimura et al. | 148/325 |
| 4,721,600 | A | * | 1/1988 | Maehara et al. | 148/325 |
| 4,765,953 | A | | 8/1988 | Hagefeldt et al. | |
| 4,832,765 | A | * | 5/1989 | DeBold et al. | 148/325 |
| 5,582,656 | A | | 12/1996 | Kangas et al. | |
| 5,716,466 | A | * | 2/1998 | Yamaoka et al. | 148/325 |
| 6,012,495 | A | * | 1/2000 | Antonsen | 138/131 |
| 6,312,532 | B1 | | 11/2001 | Kangas | 148/325 |

FOREIGN PATENT DOCUMENTS

| | | |
|---|---|---|
| EP | 0 220 141 A2 | 4/1987 |
| EP | 0 534 864 A1 | 3/1993 |
| EP | 0 818 552 A2 | 1/1998 |
| WO | 95/00674 A1 | 1/1995 |
| WO | 00/79017 A1 | 12/2000 |

OTHER PUBLICATIONS

Metals Handbook vol. 1, 10$^{th}$ edition. "Properties and Selection: Irons, Steels, and HIgh–Performance Alloys". 1990. p. 673.*

Billingham et al, "Review of the performance of high strength steels used offshore", 2003, pp. 7–10, 19–21.*

* cited by examiner

*Primary Examiner*—Roy King
*Assistant Examiner*—Harry D. Wilkins, III
(74) *Attorney, Agent, or Firm*—Burns, Doane, Swecker & Mathis, L.L.P.

(57) ABSTRACT

The present invention relates to a duplex stainless steel alloy with austenite-ferrite structure, which in hot extruded and annealed finish shows high strength, good corrosion resistance, as well as good weldability which is characterized in that the alloy contains in weight-% max 0.05% C, 0–2.0% Si 0–3.0% Mn, 25–35% Cr, 4–10% Ni, 2–6% Mo, 0.3–0.6% N, as well as Fe and normally occurring impurities and additions, whereby the content of ferrite is 30–70%.

27 Claims, 5 Drawing Sheets

DUPLEX STAINLESS STEEL

FIELD OF THE INVENTION

The present invention relates to a duplex stainless steel with high contents of Cr, Mo and N. The content of ferrite is 30–70%. The material is especially suited for production tubes for extraction of crude oil and gas, but can also be used in applications where good corrosion resistance together with high strength is required.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Duplex steels are characterized by an austenite-ferrite structure where both phases have different chemical compositions. Modern duplex stainless steels will mainly be alloyed with Cr, Mo, Y and N. Swedish Patent 8504131-7 describes a duplex stainless steel grade with commercial denotation SAF 2507 (UNS S32750), which is mainly alloyed with high contents of Cr, Mo and N for good resistance to pitting corrosion. This resistance is often described with a PRE-number (PRE=Pitting Resistance Equivalent=% Cr+3.3% Mo+16% N). Thus, the alloy is consequently optimized with respect to this property, and has certainly good resistance in many acids and bases, but above all the alloy is developed for resistance against chloride environments. Cu and W were subsequently also used as alloying additions. Consequently, a steel grade with commercial denotation DP3W has a composition similar in character as SAF 2507, but it has been alloyed with 2.0% W as substitute for a part of the Mo content in the alloy. A steel grade with commercial denotation Zeron 100 is a further steel grade of a similar kind as SAF 2507, but this is alloyed with approximately 0.7% Cu and approximately 0.7% W. All above-described steel grades have a PRE-number higher than 40 irrespective to the method of calculation.

Another type of duplex alloy with high resistance to chloride is the steel grade described in the Swedish Patent 9302139-2. This alloy is characterized by Mn 0.3–4%, Cr 28–35%, Ni 3–10%, Mo 1–3%, Cu max 1.0% and W max 2.0%, and has a high PRE-number above 40. The biggest difference compared to the established superduplex steels SAF 2507 and others is that the contents of Cr and N are higher in this steel grade. The steel grade has found use in environments where resistance to intergranular corrosion and corrosion in ammonium carbamate is of importance, but the alloy has also a very high resistance to corrosion in chloride environments.

In oil and gas extraction applications, duplex steels are used in the form of production tubes, e.g.—tubes that transport oil up from the source to the oil-rig. Oil wells contain carbon dioxide ($CO_2$) and sometimes even hydrogen sulphide ($H_2S$). An oil well containing $CO_2$ but no bigger multitudes of $H_2S$ is called a sweet oil well. A sour oil well, however, contains $H_2S$ in varying amounts.

The production tubes will be supplied in threaded finish. By means of couplings the tubes will be joined to the necessary lengths. Because oil wells are situated at a considerable depth the length of a production tube can become large. Demands on the material, which shall be used in this application, can be summarized according to the following:

* Yield point in tension min 110 ksi (760 MPA)
* Resistance to corrosion caused by $CO_2$ or $H_2S$. Material should be qualified and included in for example the standard NACE MR-0175
* Good impact strength down to −46° C., at least 50J
* Further the material shall be possible to manufacture in the shape of seamless tubes as well as that one can produce threads and fitting couplings for tubes.

In the present-day situation either low alloyed carbon steels, austenitic stainless steel, duplex stainless steel or nickel-based alloys, are used for such applications, depending on the level of corrosive activity in the oil well. Limits for different materials have been taken out. For sweet oil wells one can normally use carbon-steel or low alloyed stainless steel, for example, martensitic 13Cr-steel. In sour oil wells, where the partial pressure for $H_2S$ exceeds 0.01 psi, normally the use of a stainless steel is required.

Duplex steels are, among other things, are an economical alternative to stainless steels and nickel-based alloys, thanks to a low content of nickel. The duplex steels fill the gap between high-alloyed steels and low-alloyed carbon steels and martensitic 13Cr-steel. A typical application range for duplex steels of the type 22Cr and 25Cr is where the partial pressure of $H_2S$ in the gas in the oil well lies in the area 0.2 to 5 psi.

Since there is a requirement on the strength level of at least 110 ksi, 22Cr-och 25Cr-steel is supplied with a cold rolled finish, which increases the strength to desired level, but this also limits the resistance of the material against stress corrosion caused by $H_2S$. Material of the type 22Cr, in an annealed condition, has only a yield point limit of 75 ksi, a corresponding value for 25Cr is 80 ksi. Besides, from the production point of view it is difficult to produce production tubes from such materials, because the strength depends of both the total degree of reduction and the type of method for the reduction, i.e.—drawing or rolling. Additionally, a cold rolling operation is costly for the production. The impact toughness of the material deteriorates considerably by the cold rolling, which further limits the applicability of such materials.

In order to solve these problems there is a need of an alloy which can be delivered in a hot extruded and annealed finish, where the strength is at least 110 ksi. Simultaneously, the alloy shall have good workability and, without problems, can be extruded into seamless tubes. The strength of duplex alloys can be increased by alloying with high contents of the elements Cr, Mo and N. In the present day situation there are duplex steels with up to 29% Cr and 0.4% N, which have yield point limits of 95 ksi, but in this alloy the content of Mo must be held low in order to avoid precipitations of, for example, the phase. When the content of Mo is high, the content of Cr has to be reduced to approximately 25% if one wants to retain the structural stability. Thus, there seems to exist an upper limit for the combination of Cr and Mo in order to retain the structural stability. The content of N is limited upwards to 0.3%, for 25% Cr alloys and to 0.4% for 29% Cr alloys.

SUMMARY OF THE INVENTION

Figure 1:
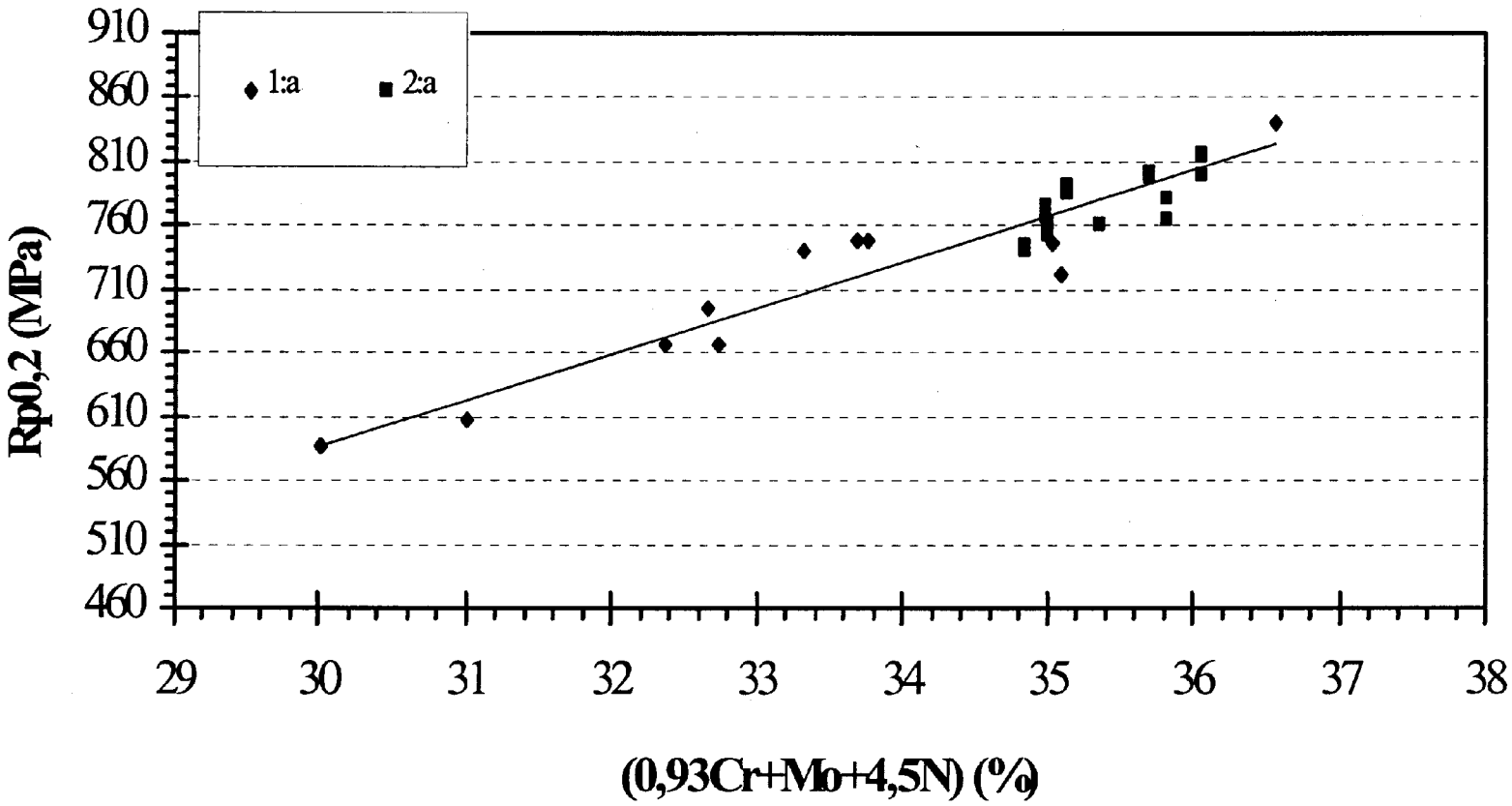
FIG. 1 shows a linearized plot of the yield strength vs. the alloy content.

Systematic development work has surprisingly shown that by simultaneously elevating the elements Cr, Mo and N to high levels an unexpected positive synergistic effect of the elements is obtained. Partly it shows that Cr and Mo increase the solubility of N, which in its turn enables higher contents of Cr and Mo without precipitating higher amounts of intermetallic phase such as sigma phase. It is previously known that Cr and Mo increase the solubility of N, but the presently obtained contents are higher compared to what earlier was estimated as upper limits for what is possible to attain. The high contents of Cr, Mo and N give the alloy a very high strength and simultaneously a good workability for extrusion into seamless tubes. The yield point in tension exceeds 110 ksi in extruded and annealed condition, and the material also shows good corrosion properties. In order to obtain a combination of high strength and good impact toughness, an accurate one has to combination of the amounts of content of elements Cr, Mo and N must prevail.

Besides exhibiting excellent mechanical properties the new alloy has a high resistance to pitting corrosion and crevice corrosion in chloride environments as well as a high resistance to stress corrosion cracking caused by hydrogen sulphide. In addition, the alloy is weldable, which means that the alloy according to the present invention is well suited for applications that require welding, such as butt-welded seamless tubes and seam-welded tubes for various coiled tubing applications. Consequently, the alloy is especially suited for hydraulic tubes, such as umbilical tubes, which are used in order to control platforms in oilfields.

According to one aspect, the present invention provides a duplex stainless steel alloy having austenite-ferrite microstructure exhibiting, when hot extruded and having an annealed finish, has good weldability, high strength as well as good and high resistance to corrosion, wherein the alloy comprises, in weight-%:

| | |
|---|---|
| C | max 0.05%; |
| Si | 0–2.0%; |
| Mn | 0–3.0%; |
| Cr | 25–35%; |
| Ni | 4–10%; |
| Mo | 2–6%; |
| N | 0.3–0.6%; and |

Fe and normally occurring impurities and additions;

wherein the ferrite content is 30–70% by volume.

According to a further aspect, the present invention provides an extruded seamless tube formed from the above-mentioned alloy, the tube having a yield point in tension, which exceeds 760 MPa.

According to a further aspect, the present invention provides an umbilical tube formed from the above-mentioned alloy.

According to another aspect, the present invention provides an article possessing resistance against corrosion in seawater formed from the above-mentioned alloy.

According to yet another aspect, the present invention provides, an article having high strength and good corrosion resistance, the article formed from the above-mentioned alloy, the article being in the form of a seamless tube, a welding wire, a seam-welded tube, a strip, a wire, a rod, a sheet, a flange or a coupling.

According to a further aspect, the present invention provides a plurality of butt-welded seamless or seam-welded tubes reeled into a coil formed from the above-mentioned alloy.

DETAILED DESCRIPTION OF THE INVENTION

According to one aspect, the present invention provides an alloy having a composition which comprises, in weight-%:

| | |
|---|---|
| C | max 0.05% |
| Si | 0–2.0% |
| Mn | 0–3.0% |
| Cr | 25–35% |
| Ni | 4–10% |
| Mo | 2–6% |
| N | 0.3–0.6% |

balance Fe and normally occurring impurities and additions whereby ferrite content is 30–70 volume-percent.

The principles and advantages of the alloy of the present invention, and selection of the desired ranges of the constituent elements of the alloy of the present invention which render the unexpected superiority of the alloy can be stated as follows.

Carbon has to be considered a contaminant in this invention and has a limited solubility in both ferrite and austenite. The limited solubility implies a risk of precipitation of chromium carbides and the content should therefore be limited to max 0.05%, preferably to max 0.03% and most preferably to max 0.02%.

Silicon is utilized as deoxidizer under the steel production as well as it increases the floatability under production and welding. It is earlier known that high contents of Si support the precipitation of an intermetallic phase. It has surprisingly shown that an increased content of Si favorably affects the precipitation of sigma phase. For this reason a certain content of Si should be optionally permitted. However, the content of Si should be limited to max 2.0%.

Manganese will be added in order to increase the solubility of N in the material. However, Mn has only a limited influence on the solubility of N in the actual type of alloy. Instead, there are other elements with higher influence on the solubility. Besides, Mn in combination with high contents of sulphur can be the cause of manganese sulfides, which act as initiation points for pitting corrosion. The content of Mn should therefore be limited to between 0–3%, and preferably 0.5%–1.5%.

Chromium is a very active element in order to improve the resistance to the plurality of corrosion types. Moreover, chromium increases the strength of the alloy. A high content of chromium implies additionally a very good solubility of N in the material. Consequently, it is desirable to keep the Cr-content as high as possible in order to improve the strength and the resistance to corrosion. For the very good strength properties and resistance to corrosion the content of chromium should be at least 25%, preferably at least 29%. However, high contents of Cr increase the risk for intermetallic precipitations. For this reason the content of chromium should be limited upwards to max 35%.

Nickel will be used as an austenite-stabilizing element and will be added to the alloy in suitable level in order to attain desirable content of ferrite. In order to attain ferrite-contents of between 30–70%, alloying with 4–10% nickel, preferably 5–9%, is required.

Molybdenum is an active element, which improves the resistance to corrosion in chloride environments, as well as in reducing acids. An excessive Mo-content in combination with a high Cr-content means that the risk for intermetallic precipitations increases. Since Mo increases the strength, the content of Mo should in the present invention lie in the range of 2–6%, preferably 3–5%.

Nitrogen is a very active element, which partly increases the resistance to corrosion and partly increases the structural stability as well as the strength of the material. Besides, a high N-content improves the reformation of austenite after welding, which ensures good properties for welded joints. In order to attain a good effect of N, at least 0.3% N should be added. High contents of N increases the risk for precipitation of chromium nitrides, especially when the content of chromium is also high. Furthermore, a high N-content implies that the risk for porosity increases because of that the solubility of N in the steel melt or weld pool will be exceeded. Thus, the N-content should be limited to max 0.60%, preferably 0.45–0.55% N.

The content of ferrite is important in order to obtain good mechanical properties and corrosion properties, as well as good weldability. From a corrosion point of view and welding point of view, it is desirable with a content of ferrite between 30–70% in order to obtain good properties. High contents of ferrite cause deterioration in low temperature impact toughness and resistance to hydrogen embrittlement. Therefore, the content of ferrite is therefore 30–70%, preferably 35–55%.

EXAMPLE 1

In the example below the composition of a number of experimental heat illustrates the influence of different alloying elements on the properties.

A number of experimental heats were produced by casting of 170 kg ingots, which were hot-forged into round bars. The bars were hot extruded into rods, from which the test material was taken out. From a material point of view the process can be considered being representative for the preparation in bigger scale, for example the production of seamless tubes with the extrusion method. Table 1 shows the composition of these experimental heats.

TABLE 1

Composition for experimental heats, weight %

| Heat | Cr | Ni | Mo | Mn | N | C |
|---|---|---|---|---|---|---|
| 605123 | 30.11 | 3.71 | 2.98 | 2.54 | 0.60 | 0.011 |
| 605125 | 29.93 | 9.01 | 3.0 | 2.87 | 0.34 | 0.014 |
| 605127 | 29.7 | 7.98 | 1.03 | 0.37 | 0.30 | 0.011 |
| 631928 | 33.4 | 7.02 | 2.93 | 3.01 | 0.57 | 0.013 |
| 631930 | 33.7 | 6.64 | 1.19 | 0.29 | 0.57 | 0.012 |
| 631931 | 33.8 | 10.81 | 0.97 | 3.05 | 0.30 | 0.012 |
| 631933 | 29.8 | 4.92 | 2.99 | 0.32 | 0.58 | 0.015 |
| 631934 | 30.6 | 9.56 | 2.93 | 2.89 | 0.30 | 0.012 |
| 631936 | 31.1 | 3.82 | 1.0 | 3.0 | 0.61 | 0.017 |
| 631937 | 30.7 | 8.64 | 1.04 | 0.31 | 0.31 | 0.014 |
| 631945 | 31.8 | 8.29 | 3.48 | 0.99 | 0.44 | 0.013 |

In order to investigate structural stability, the samples were annealed at 800–1200° C. with 50° C. steps. At the lowest temperatures, an intermetallic phase was formed. The lowest temperature, where the amount of intermetallic phase was insignificantly small, was determined with the help of studies using a light optical microscope. The material was then annealed at this temperature during three minutes, then it was quenched with a constant rate of −140° C./min to room temperature. The amount of sigma phase in this material was calculated with the assistance of point counting with a light optical microscope. The results are shown in Table 2.

TABLE 2

Amount of sigma phase after quenching with quenching rate of −140° C./min from respective annealing temperature to room temperature.

| Heat | Temperature ° C./20 MIN | Amount σ phase |
|---|---|---|
| 605123 | 1150 | <1% |
| 605125 | 1100 | 50% |
| 605127 | 1000 | <1% |
| 631928 | 1100 | 30% |
| 631930 | 1050 | <1% |
| 631931 | 1150 | 25% |
| 631933 | 1150 | <1% |
| 631934 | 1100 | 40% |
| 631936 | 1150 | <1% |
| 631937 | 1100 | <1% |
| 631945 | 1100 | 20% |

From Table 2 it becomes evident that material which fulfills two of three of the conditions shows a bigger tendency to form sigma phase during cooling. The three conditions are:

* High content of Cr
* High content of Mo
* Low content of N.

The strength and impact toughness were determined for all heats. Static tensile test specimens were produced from extruded rods, which were solution heat treated at temperatures according to Table 2. The results of the investigations are shown in Tables 3 and 4.

TABLE 3

Mechanical properties, rupture strength at room temperature (RT), 100° C. and 200° C.

| Heat | Temperature | Rp 0.2 (MPa) | Rp 1.0 (MPa) | Rm (%) | A5 (%) | Z |
|---|---|---|---|---|---|---|
| 605123 | RT | 749 | 833 | 926 | 36.1 | |
| | 100° C. | 635 | 707 | 843 | 39.2 | 61 |
| | 200° C. | 558 | 624 | 804 | 36.3 | 57 |
| 605125 | RT | 667 | 769 | 901 | 36.8 | |
| | 100° C. | 570 | 653 | 816 | 37.8 | 72 |
| | 200° C. | 503 | 566 | 763 | 32.9 | 70 |
| 605127 | RT | 586 | 678 | 832 | 39.1 | |
| | 100° C. | 474 | 565 | 750 | 40 | 71 |
| | 200° C. | 401 | 473 | 688 | 38 | 70 |
| 631928 | RT | 841 | 924 | 994 | 33.5 | |
| | 100° C. | 692 | 783 | 897 | 36.6 | 63 |
| | 200° C. | 622 | 698 | 856 | 33.4 | 59 |
| 631930 | RT | 722 | 827 | 943 | 31 | |
| | 100° C. | 611 | 697 | 850 | 34.5 | 53 |
| | 200° C. | 538 | 606 | 791 | 30.7 | 51 |
| 631931 | RT | 749 | 848 | 938 | 32.1 | |
| | 100° C. | 668 | 734 | 859 | 33.3 | 67 |
| | 200° C. | 583 | 640 | 796 | 29.4 | 63 |
| 631933 | RT | 740 | 825 | 919 | 36.2 | |
| | 100° C. | 610 | 694 | 833 | 38.1 | 64 |
| | 200° C. | 558 | 618 | 792 | 36.2 | 59 |

TABLE 3-continued

Mechanical properties, rupture strength at room temperature (RT), 100° C. and 200° C.

| Heat | Temperature | Rp 0.2 (MPa) | Rp 1.0 (MPa) | Rm (%) | A5 (%) | Z |
|---|---|---|---|---|---|---|
| 631634 | RT | 666 | 783 | 900 | 35.4 | |
| | 100° C. | 577 | 672 | 826 | 35.8 | 72 |
| | 200° C. | 502 | 577 | 763 | 32.6 | 67 |
| 631936 | RT | 695 | 776 | 883 | 39.1 | |
| | 100° C. | 581 | 651 | 801 | 41.9 | 66 |
| | 200° C. | 512 | 573 | 767 | 39 | 59 |
| 631637 | RT | 608 | 705 | 837 | 38.4 | |
| | 100° C. | 507 | 592 | 756 | 39.8 | 72 |
| | 200° C. | 431 | 501 | 701 | 37.2 | 69 |
| 631945 | RT | 747 | 841 | 942 | 37.1 | |
| | 100° C. | 608 | 714 | 855 | 38.1 | 68 |
| | 200° C. | 562 | 629 | 807 | 34.2 | 65 |

Results of the rupture strength tests show that contents of Cr, Mo and N strongly influence the rupture strength of the material.

TABLE 4

Mechanical properties, impact toughness at room temperature (RT) and −46° C. as average of 3 tests.

| Heat | Temperature | Impact toughness (J) |
|---|---|---|
| 605123 | RT | 33 |
| | −46° C. | 5 |
| 605125 | RT | 232 |
| | −46° C. | 237 |
| 605127 | RT | 196 |
| | −46° C. | 190 |
| 631928 | RT | 59 |
| | −46° C. | 10 |
| 631930 | RT | 36 |
| | −46° C. | 17 |
| 631931 | RT | 180 |
| | −46° C. | 125 |
| 631933 | RT | 50 |
| | −46° C. | 6 |
| 631634 | RT | 224 |
| | −46° C. | 238 |
| 631936 | RT | 47 |
| | −46° C. | 6 |
| 631637 | RT | 250 |
| | −46° C. | 253 |
| 631945 | RT | 206 |
| | −46° C. | 112 |

It becomes evident that the heats can be divided into in two categories; those with high impact toughness, which have impact toughness above 180 J, and those which are considerable more brittle with impact toughness around or under 60 J. It shows that the impact toughness is much strongly correlated to the chemical composition in the austenite phase, particularly to the content of nitrogen and chromium are of importance. It shows during the continued studies that high N-contents in the austenite result in brittle fractures.

The pitting corrosion properties were partly tested by electrochemical testing in 3% NaCl and synthetic seawater (6 tests per heat) and partly testing according to ASTM G48C (2 tests per heat). The results from all tests are shown in Table 5.

TABLE 5

CPT for the various heats in degrees Celsius and PRE-number for the total composition of the alloy.

| Heat | PRE (Cr + 3.3MO + 16N) | CPT ° C. (3% NaCl) | CPT ° C. (Synthetic sea-water ASTM B1141) | CPT ° C. ASTM 48C |
|---|---|---|---|---|
| 605123 | 49.5 | 35 | 45 | 40 |
| 605125 | 45.3 | 79 | 77 | 78 |
| 605127 | 37.9 | 66 | 62 | 50 |
| 631928 | 52.2 | 65 | 67.5 | 50 |
| 631930 | 46.7 | 59 | 63 | 40 |
| 631931 | 41.8 | 54 | 52.5 | 40 |
| 631933 | 48.9 | 43 | 49 | 40 |
| 631934 | 45.1 | 62.5 | 76 | 80 |
| 631936 | 44.2 | 32.5 | 34 | 40 |
| 631937 | 39.1 | 61 | 58 | 40 |
| 631945 | 50.4 | 81 | 82.5 | 78 |

The heats 605125, 631934 and 631945 have surprisingly high CPT both at tests according to G48 and electrochemical. These heats have all relatively high PRE-numbers(>45). That there exists a correlation between PRE and CPT is apparent as well as that the PRE-number for the composition of the heat not solely explains CPT.

EXAMPLE 2

In the following example the composition of a number of experimental heats is indicated, which are included in order to illustrate the influence of different alloying elements on the properties.

Nine experimental heats were produced by casting of 170 kg ingots, which were hot forged into round bars. Those were hot extruded into rods, from which the test material was taken out. The composition of these nine heats is based on the compositions from EXAMPLE 1. Table 6 shows the composition for these experimental heats.

TABLE 6

Composition for experimental heats, weight %

| Heat | Cr | Ni | Mo | Mn | N | C |
|---|---|---|---|---|---|---|
| 605160 | 31.74 | 8.11 | 3.50 | 1.05 | 0.44 | 0.012 |
| 605161 | 31.85 | 7.25 | 3.47 | 0.90 | 0.50 | 0.014 |
| 605162 | 31.8 | 7.27 | 2.98 | 0.86 | 0.5 | 0.012 |
| 605164 | 31.86 | 7.36 | 3.95 | 0.86 | 0.498 | 0.012 |
| 605165 | 31.0 | 6.94 | 3.98 | 1.05 | 0.49 | 0.012 |
| 605166 | 30.90 | 6.10 | 3.95 | 0.95 | 0.544 | 0.012 |
| 605168 | 32.77 | 7.88 | 2.96 | 1.00 | 0.502 | 0.014 |
| 605169 | 32.93 | 6.96 | 3.00 | 0.92 | 0.542 | 0.016 |

The six first heats in Table 6 are variants of heat 631945 in example 1, the following two heats are variants of heat 631928 in example 1, and the last is a variant of heat 631931 in example 1.

Distribution of the alloying elements in the ferrite and austenite phases was examined with micro probe analysis, results hereof appear from Table 7.

TABLE 7

Alloying elements in ferrite respective austenite phase.

| Heat | Phase | Si | Cr | Mn | Ni | Mo | N |
|---|---|---|---|---|---|---|---|
| 605160 | Aust | 0.01 | 30.1 | 1.18 | 9.9 | 3 | 0.8 |
| | Ferrite | 0.05 | 33.1 | 1.06 | 6.4 | 4.6 | 0.08 |
| 605161 | Aust | 0 | 30.4 | 0.95 | 8.5 | 2.9 | 0.89 |
| | Ferrite | 0 | 32.6 | 0.84 | 5.6 | 4.5 | 0.1 |
| 605164 | Aust | 0 | 30.4 | 0.91 | 8.6 | 3.3 | 0.87 |
| | Ferrite | 0 | 32.5 | 0.81 | 5.8 | 5.2 | 0.08 |
| 605162 | Aust | 0 | 30.2 | 1.04 | 8.4 | 2.5 | 0.85 |
| | Ferrite | 0 | 32.8 | 0.92 | 5.5 | 3.9 | 0.08 |
| 605165 | Aust | 0.02 | 29.2 | 1.14 | 8.1 | 3.3 | 0.87 |
| | Ferrite | 0.06 | 31 | 1.02 | 5.4 | 5.1 | 0.07 |
| 605166 | Aust | 0 | 29.3 | 1.04 | 7.2 | 3.1 | 0.89 |
| | Ferrite | 0 | 30.3 | 0.92 | 4.9 | 4.7 | 0.05 |
| 605168 | Aust | 0 | 30.3 | 1.11 | 9.3 | 2.4 | 0.83 |
| | Ferrite | 0 | 32.9 | 0.99 | 6.2 | 3.6 | 0.06 |
| 605169 | Aust | 0 | 30.6 | 0.99 | 8.2 | 2.4 | 0.89 |
| | Ferrite | 0 | 32.6 | 0.87 | 5.5 | 3.7 | 0.06 |

In order to examine the structural stability of the experimental heats in this example, test specimens were annealed during 20 min at 1025° C., 1050° C., 1075° C., 1100° C. and 1125° C., thereafter they were quenched in water. The temperature, where the amount of intermetallic phase became insignificantly small was determined with the help of investigations in a light-optical microscope. The test specimens for the investigation of the structural stability were annealed in a vacuum furnace at respective temperature during three minutes, whereafter they were quenched with a rate of −140° c./min to room temperature. The amount of sigma phase in this material was determined by point counting using a light-optical microscope. The results are shown in Table 8.

TABLE 8

Amount of sigma phase after quenching from respective annealing temperature to room temperature.

| Heat | Temperature ° C. | Amount σ phase |
|---|---|---|
| 605160 | 1100 | 10% |
| 605161 | 1100 | <1% |
| 605162 | 1075 | <1% |
| 605164 | 1100 | 5% |
| 605165 | 1100 | <1% |
| 605166 | 1075 | <1% |
| 605168 | 1100 | 5% |
| 605169 | 1075 | <1% |

It appears from Table 8 that the optimized composition of the materials diminishes or wholly eliminated the amount of precipitated sigma phase. The Table 8 values lie substantially under the values in example 1 (Table 2). Consequently, these heats have a more optimal composition.

The strength and the impact toughness have been determined for all heats in Table 6. Static tensile test specimen were produced from extruded rods, which were heat-treated at temperatures according to Table 8. The results of the tests are shown in Tables 9 and 10.

TABLE 9

Mechanical properties, tensile strength at room temperature.

| Heat | Rp 0.2 (MPa) | Rp 1.0 (MPa) | Rm (MPa) | A5 (%) | Z (%) |
|---|---|---|---|---|---|
| 605160 | 757 | 851 | 975 | 35 | 66 |
| 605161 | 761 | 854 | 977 | 35 | 63 |
| 605162 | 743 | 830 | 962 | 37 | 64 |
| 605164 | 776 | 875 | 978 | 34 | 62 |
| 605165 | 771 | 847 | 959 | 34 | 62 |
| 605166 | 789 | 869 | 964 | 34 | 58 |
| 605168 | 800 | 872 | 962 | 36 | 67 |
| 605169 | 809 | 886 | 976 | 34 | 60 |

Results of tensile strength tests in example 1 and 2 (Tables 3 and 9) show that the contents of Cr, Mo and N strongly influence the tensile strength in the material. It shows that the mutual influence of the contents of these alloying elements on the tensile strength remains as (0.93% Cr)+% Mo+(4.5% N), see FIG. 1. In order to obtain a tensile above 760 MPa following should be valid (0.93% Cr)+% Mo+(4.5% N)≧35.

TABLE 10

Mechanical properties, impact toughness at room temperature (RT) and −46° C. average of 3 tests.

| Heat | Impact toughness (RT) | Impact toughness (−46 ° C.) |
|---|---|---|
| 605160 | 234 | 197 |
| 605161 | 198 | 70 |
| 605162 | 216 | 100 |
| 605164 | 146 | 48 |
| 605165 | 218 | 56 |
| 605166 | 68 | 19 |
| 605168 | 201 | 51 |
| 605169 | 72 | 25 |

Figure 2A:
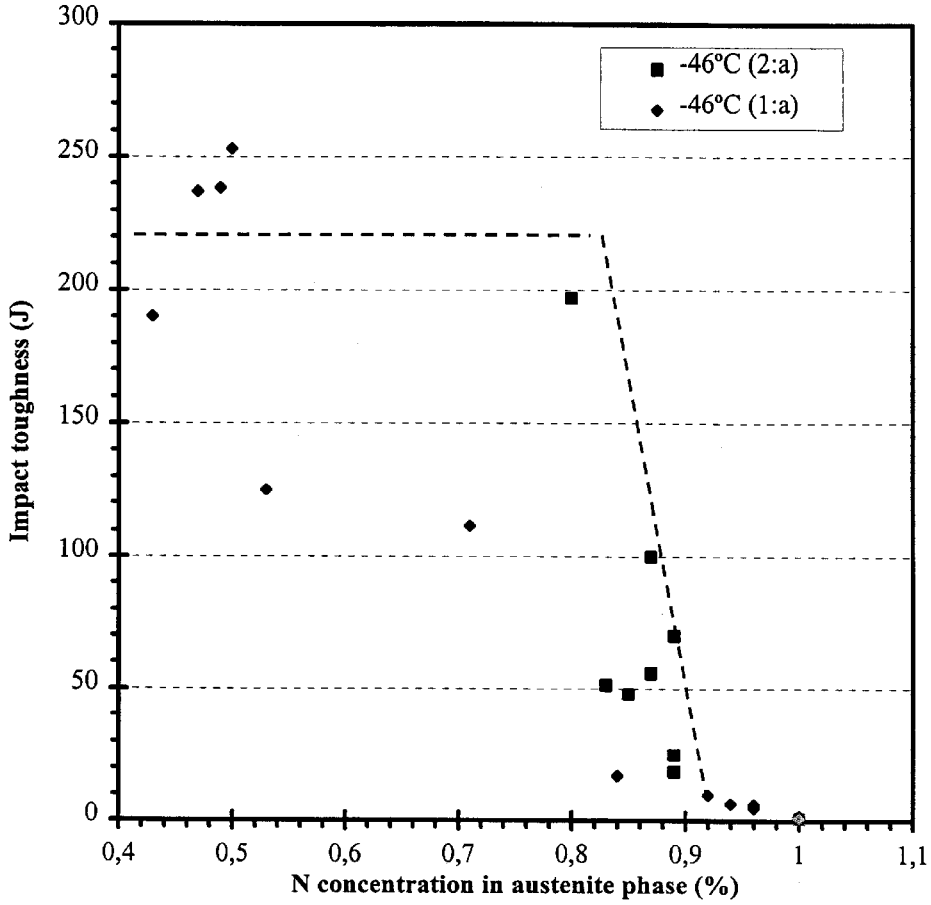
FIG. 2*a* shows the impact toughness as −46° C. as feature of N-content in the austenite phase.
Figure 2B:
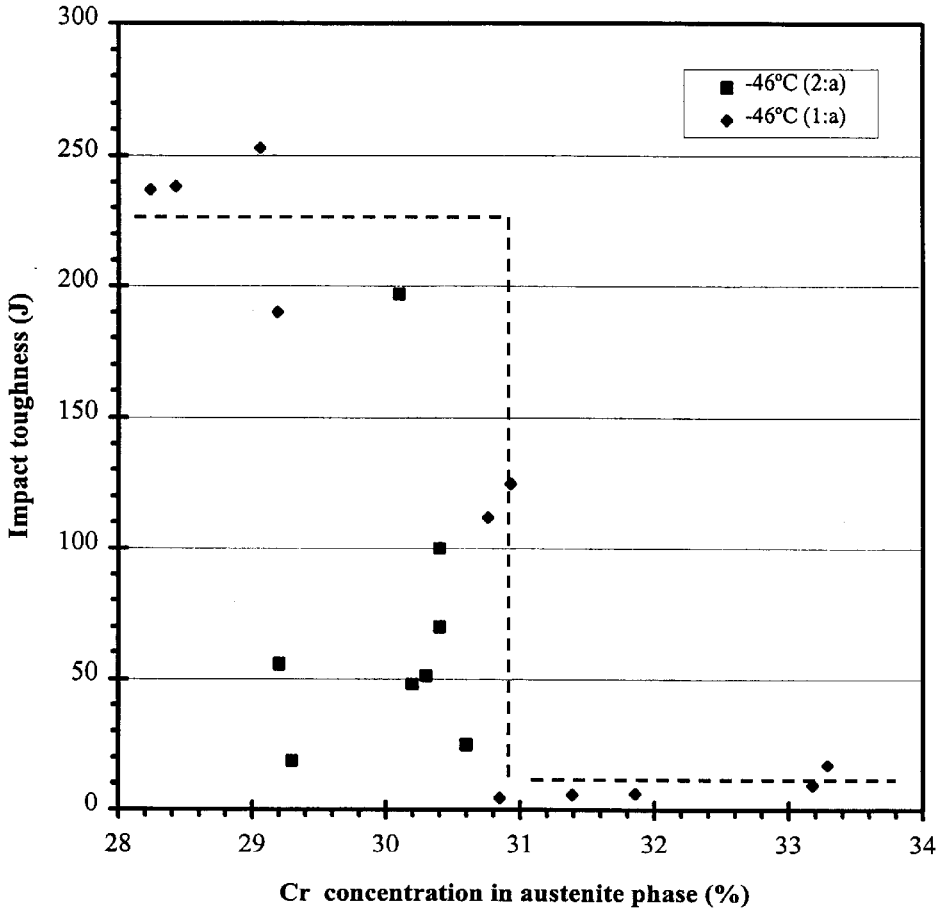
FIG. 2*b* shows the impact toughness at −46° C. as a feature of the Cr-content in the austenite phase.

The impact toughness tests in example 1 and 2 (Tables 4 and 10) show that the impact strength strongly depends on the contents of N and Cr in the austenite phase. This relationship is distinct in FIGS. 2*a*–2*b*. A transition to a more brittle fraction occurs at Cr-contents above 31% and N-content above 0.9%.

The pitting corrosion properties were investigated by determining the Critical Pitting Corrosion Temperature (CPT) according to ASTM G48C (2 tests per heat). The results appear from Table 11. In addition, in Table 11 the PRE-numbers for the ferrite respective austenite phase are given, the contents have been obtained by micro probe analysis. In this connection the PRE-number is defined as PRE=% Cr+3.3% Mo+16% N.

TABLE 11

CPT for the various heats in degrees Celsius and PRE-number for the total composition of the alloy.

| Heat | PRE (Ferrite) | PRE (Austenite) | CPT ° C. (ASTM G48) |
|---|---|---|---|
| 605160 | 49.6 | 52.8 | 75 |
| 605161 | 49.1 | 54.3 | 80 |
| 605162 | 47.0 | 52.1 | 70 |
| 605164 | 50.9 | 55.2 | 88 |
| 605165 | 49.0 | 54.0 | 80 |

TABLE 11-continued

CPT for the various heats in degrees Celsius and PRE-number for the total composition of the alloy.

| Heat | PRE (Ferrite) | PRE (Austenite) | CPT ° C. (ASTM G48) |
|---|---|---|---|
| 605166 | 46.6 | 53.8 | 60 |
| 605168 | 45.7 | 51.5 | 65 |
| 605169 | 45.8 | 52.8 | 53 |

Figure 3:
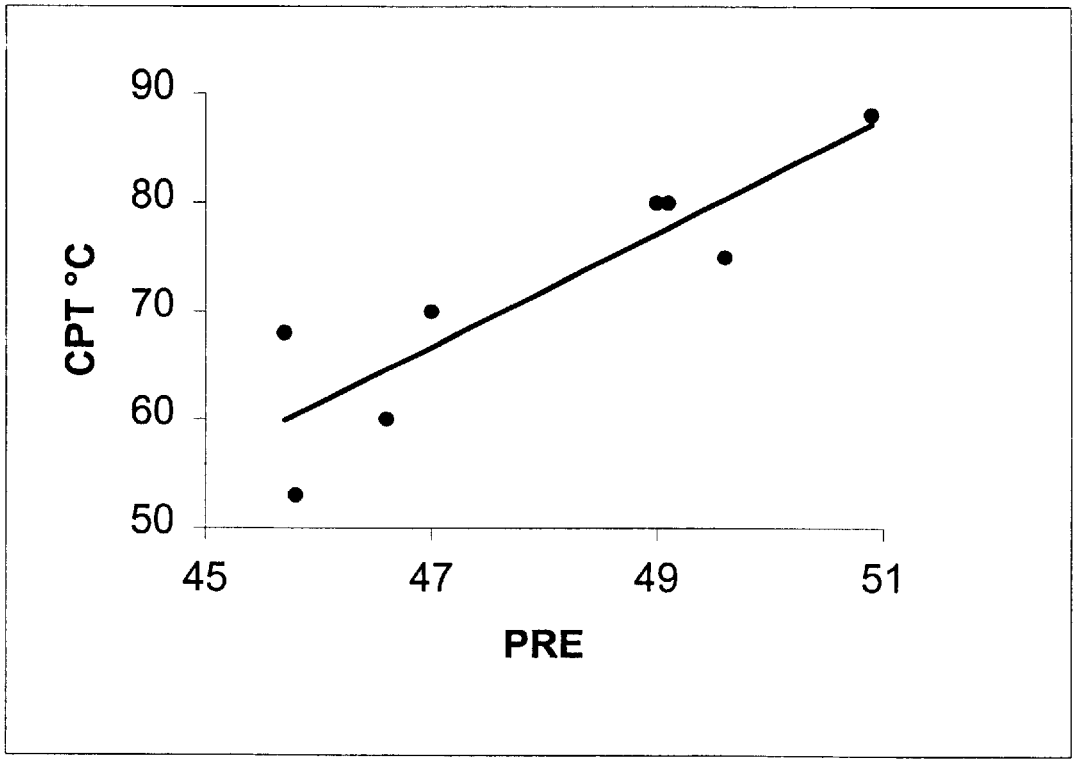
FIG. 3 shows the resulting CPT temperatures vs. calculated PRE-numbers from the ferrite phase.

It is previously known that a linear relationship between that lowest of the PRE-numbers for the austenite or ferrite in a given alloy, and the CPT-value, exists for duplex steels of medium alloy content. Consequently, the lowest alloyed phase limits the resistance to pitting corrosion. In this investigation it is confirmed that this relationship even exists in those considerably higher alloyed materials. This is further illustrated in FIG. 3, which shows the measured CPT-values in relation to the calculated PRE-numbers from the ferrite phase, which is the weaker phase in this example.

Tests with TIG-remelting were carried out on all heats. Weldability and microstructure have been studied. The results are presented in Table 12.

TABLE 12

Result of tests with TIG-remelting.

| Heat | Precipitations |
|---|---|
| 605160 | Small amounts |
| 605161 | Small amounts |
| 605162 | Small amounts |
| 605164 | Small amounts |
| 605165 | Small amounts |
| 605166 | $Cr_2N$ |
| 605168 | $Cr_2N$ |
| 605169 | $Cr_2N$ |

It appears from the above investigation that the weldability of the material is strongly dependent on the N-content. It is possible to find a maximum N-content for this type of alloy. By comparison of the heats 605165 and 605166 it is apparent that the N-content should preferably not exceed 0.5%.

Optimum composition of a preferred embodiment of the present invention:

In order to obtain high strength and good impact toughness properties, at the same time as the material is structural stable, weldable and has good corrosion properties, the material should be alloyed according to the following:

Nitrogen-content in the austenite measured with for example micro probe should not exceed 0.9%, and preferably nor more than about 0.8%.

Chromium-content in the austenite phase measured with, for example, a micro probe should not exceed 31.0%, and is preferably not more than about 30.5%.

Total nitrogen content of the alloy should not exceed 0.50%.

Chromium, molybdenum and nitrogen should be added so that the relationship $35 \leqq 0.93\ Cr+Mo+4.5\ N$ is fulfilled The PRE-number is preferably 45.7–50.9 in the ferrite phase. The PRE-number is preferably 51.5–55.2 in the austenite phase.

The ferrite-content should lie in the range of 35–55%, by volume.

EXAMPLE 3

The following example shows the influence of an increased content of Si on the stability of the sigma phase for the alloy.

Thermodynamic calculations comparing a test heat and a full scale produced material, where the full scale heat 451260 resulted in an increased content of Si (see Table 13), show reduced sensitivity to precipitation of intermetallic phase, preferably sigma phase. This is illustrated of the lower temperature Tmaxσ in Table 14 for the fullscale produced alloy 451260 compared with the test heat 605161. Tmaxσ is the temperature, where the sigma phase starts to precipitate at thermodynamic equilibrium, which means that this parameter is a dimension for the structural stability of the alloy.

TABLE 13

Chemical composition for THE compared heats.

| Heat | Cr | Ni | Mo | N | Mn | Si | C |
|---|---|---|---|---|---|---|---|
| 451260 | 31.71 | 7.26 | 3.45 | 0.47 | 0.97 | 0.20 | 0.011 |
| 605161 | 31.85 | 7.25 | 3.47 | 0.5 | 0.9 | 0.05 | 0.014 |

TABLE 14

$T_\sigma$max for the compared heats.

| Heat | $T_\sigma$max [° C.] |
|---|---|
| 451260 | 993 |
| 605161 | 1006 |

Further thermodynamic studies for the composition according to Table 13 for the full scale heat 451260 confirm that an increased content of Si favors the structural stability for the steel. For these calculations the content of Si was varied between 0 and 2.5% and the solution temperature, i.e. Tmaxσ for the sigma phase, was calculated.

Figure 4:
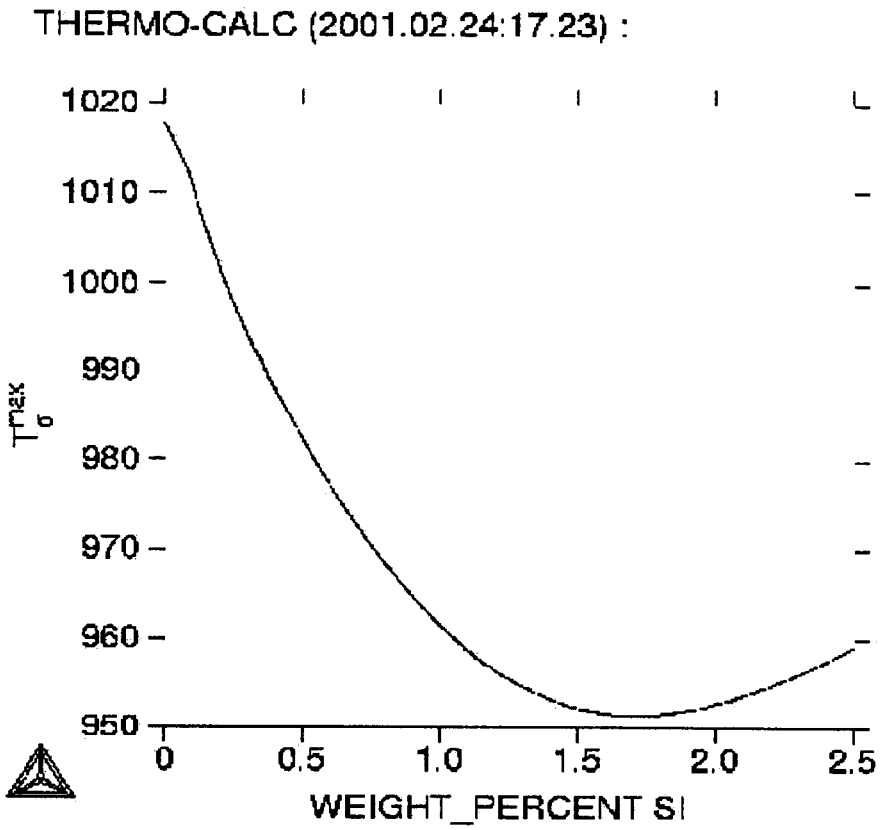
FIG. 4 shows the solution temperature for sigma phase, $T_o$max, as a function of Si-content.

According to FIG. 4, it appears that the stability of the sigma phase diminishes with increasing Si-content in the range between 0–1.7%. t this content, a minimum of the stability of the sigma phase was found and the stability increases afterwards with increasing Si-content.

Experimental investigation on full-scale produced, and test heat materials, confirms the theoretical calculations eat treatment tests were carried out with the same technique described in examples 1 and 2. The microstructure was made visible by grinding, polishing and etching, and the amount of sigma phase was measured in accordance with that described in examples 1 and 2.

The measured contents of sigma phase show that the quenching rates from 120° C./min and lower give a quick increasing content of sigma phase, while quenching rates from 160° C./min and higher give a marginal influence on the content of sigma phase (see Table 15). Comparable results from test heat 605161 show that the amount of sigma phase for the same solution and quenching conditions is significantly higher, see Table 15. This confirms that the full scale produced material shows a significantly better structural stability, compared with the test heat material. By way of thermodynamic calculation this can be related to the higher content of Si in the full scale material.

TABLE 15

| Heat | Content of sigma phase as a feature of the solution treatment/quenching rate. 90° C./min | 120° C./min | 140° C./min | 160° C./min | 180° C./min |
|---|---|---|---|---|---|
| 451260 | 0.754% | 0.227% | 0.183% | 0.079% | 0.087% |
| 605161 | 10% | 5% | <1% | | |

Thus, for the purpose of obtaining a more structurally stable material as well as to promote the weldability of the alloy, Si can advantageously be added to the material. However, the content should not exceed 2.0%.

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. A duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | 25–35%; |
| Ni | 4–10%; |
| Mo | 2–6%; |
| N | 0.3–0.6%; and |

Fe and normally occurring impurities and additions;

wherein the ferrite content is 30–70% by volume; and wherein the alloy has a hot extruded and annealed finish and exhibits a yield point limit in tension above 760 MPa.

2. The alloy of claim 1, further comprising max 0.03% C.

3. The alloy of claim 2, further comprising max 0.02% C.

4. The alloy of claim 3, further comprising 29–35% Cr.

5. The alloy of claim 4, further comprising 3–5% Mo.

6. The alloy of claim 1, wherein the content of ferrite is between 35–55%.

7. The alloy of claim 1, further comprising 0.5–1.5% Mn.

8. The alloy of claim 7, further comprising 5–9% Ni.

9. The alloy of claim 8, further comprising 0.45–0.55% N.

10. The alloy of claim 1, wherein the total content of N does not exceed 0.50%.

11. An umbilical tube formed from the alloy of claim 1.

12. An article possessing resistance against corrosion in sea water formed from the alloy of claim 1.

13. An article having high strength and good corrosion resistance, the article formed from the alloy of claim 1, the article being in the form of a seamless tube, a welding wire, a seam-welded tube, a strip, a wire, a rod, a sheet, a flange, or a coupling.

14. A plurality of butt-welded seamless tubes reeled into a coil formed from the alloy of claim 1.

15. A plurality of butt-welded and seam-welded tubes reeled into a coil formed from the alloy of claim 1.

16. The alloy of claim 1, wherein the relative amounts of the constituent alloying elements are such that a PRE number, defined as % Cr+3.3% Mo+16% N, in the ferrite phase is 45.7–50.9, and the PRE-number in the austenite phase is 51.5–55.2.

17. The alloy of claim 1, wherein the content of N in the austenite phase does not exceed 0.9%.

18. The alloy of claim 1, wherein the content of Cr in austenite phase does not exceed 30.5%.

19. A seamless tube having a hot extruded and annealed finish with a yield point in tension in excess of 760 MPa, the tube formed, at least in part, from a duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | 25–35%; |
| Ni | 4–10%; |
| Mo | 2–6%; |
| N | 0.3–0.6%; and |

Fe and normally occurring impurities and additions.

20. The seamless tube of claim 19, wherein the relative amounts of the constituent alloying elements are such that (0.93% Cr)+% Mo+(4.5% N)≧35.

21. The seamless tube of claim 19, wherein the relative amounts of the constituent alloying elements are such that a PRE number, defined as % Cr+3.3% Mo+16% N, in the ferrite phase is 45.7–50.9, and the PRE-number in the austenite phase is 51.5–55.2.

22. The seamless tube of claim 19, wherein the content of N in the austenite phase does not exceed 0.9%.

23. The seamless tube of claim 19, wherein the content of Cr in austenite phase does not exceed 30.5%.

24. A duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | greater than 30–35%; |
| Ni | 4–10%; |
| Mo | 2–6%; |
| N | 0.3–0.6%; and |

Fe and normally occurring impurities and additions;

wherein the ferrite content is 30–70% by volume; and wherein the alloy has a hot extruded and annealed finish and exhibits a yield point limit in tension above 760 MPa.

25. A seamless tube having a hot extruded and annealed finish with a yield point in tension in excess of 760 MPa, the tube formed, at least in part, from a duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | greater than 30–35%; |
| Ni | 4–10%; |
| Mo | 2–6%; |
| N | 0.3–0.6%; and |

Fe and normally occurring impurities and additions.

26. A duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | 25–35%; |
| Ni | 4–10%; |
| Mo | 2–6%; |
| N | 0.3–0.6%; and |

Fe and normally occurring impurities and additions;

wherein the ferrite content is 30–70% by volume;

wherein relative amounts of Cr, Mo and N are such that (0.93% Cr)+% Mo+(4.5% N)≧35; and wherein the alloy has a hot extruded and annealed finish and exhibits a yield point limit in tension above 760 MPa.

27. A seamless tube having a hot extruded and annealed finish with a yield point in tension in excess of 760 MPa, the tube formed, at least in part, from a duplex stainless steel alloy having a ferrite-austenite microstructure, the alloy having a composition comprising, in weight-%:

| | |
|---|---|
| C | max 0.05%; |
| Si | 0–2.0%; |
| Mn | 0–3.0%; |
| Cr | 25–35%; |
| Ni | 4–10%; |
| Mo | 2–6%; |
| N | 0.3–0.6%; and |

Fe and normally occurring impurities and additions; and wherein relative amounts of Cr, Mo and N are such that (0.93% Cr)+% Mo+(4.5% N)≧35.

* * * * *